US008749138B2

(12) United States Patent
Orito et al.

(10) Patent No.: US 8,749,138 B2
(45) Date of Patent: Jun. 10, 2014

(54) METAL HALIDE LAMP

(75) Inventors: Hidemi Orito, Saitama (JP); Masayuki Ohno, Saitama (JP); Sadaharu Nishida, Saitama (JP); Sachio Noguchi, Saitama (JP); Kazuki Kanomata, Saitama (JP); Kenji Ubukata, Saitama (JP)

(73) Assignee: Iwasaki Electric Co., Ltd. (JP)

( * ) Notice: Subject to any disclaimer, the term of this patent is extended or adjusted under 35 U.S.C. 154(b) by 0 days.

(21) Appl. No.: 13/978,223

(22) PCT Filed: Jan. 2, 2012

(86) PCT No.: PCT/JP2012/050001
§ 371 (c)(1),
(2), (4) Date: Jul. 3, 2013

(87) PCT Pub. No.: WO2012/093664
PCT Pub. Date: Jul. 12, 2012

(65) Prior Publication Data

US 2013/0285535 A1 Oct. 31, 2013

(30) Foreign Application Priority Data

Jan. 6, 2011 (JP) ..... 2011-001015

(51) Int. Cl.
*H01J 61/18* (2006.01)

(52) U.S. Cl.
USPC ..... 313/642; 313/643; 313/637; 313/638

(58) Field of Classification Search
USPC ..... 313/637–643
See application file for complete search history.

(56) References Cited

U.S. PATENT DOCUMENTS 3,590,307 A * 6/1971 Dobrusskin et al. ..... 313/144
4,155,025 A * 5/1979 Dobrusskin et al. ..... 313/112

(Continued)

FOREIGN PATENT DOCUMENTS

JP 50044675 4/1975
JP 52016886 2/1977

(Continued)

OTHER PUBLICATIONS

Japanese Office Action and Writen Opinion for Application No. PCT/JP2012/050001 dated Feb. 14, 2012.

(Continued)

*Primary Examiner* — Nimeshkumar Patel
*Assistant Examiner* — Christopher Raabe
(74) *Attorney, Agent, or Firm* — Lerner, David, Littenberg, Krumholz & Mentlik, LLP

(57) ABSTRACT

The present invention is to provide a novel ultraviolet irradiation metal halide lamp which can produce more intense light of ultraviolet region with a wavelength near 365 [nm]. This lamp is a metal halide lamp to produce mainly light of ultraviolet region. In order to produce light with a high spectrum in ultraviolet region, particularly, light of a wavelength of 350 to 380 [nm], at least mercury (Hg) and an iron are sealed into this lamp together with a rare gas. The sealed iron into the lamp is supplied by iron iodide ($FeI_2$) and iron bromide ($FeBr_2$) as iron halide ($FeX_2$) and metal iron (Fe). When a quantity of materials sealed into the lamp is expressed such that A represents a quantity of metal iron sealed into the lamp, B represents a quantity of iron iodide sealed into the lamp and C represents a quantity of iron bromide sealed into the lamp, respectively, the quantity A of the metal iron falls within the range of $0.5(B+C) \leq A \leq 10.0(B+C)$ [mol/cm$^3$], the quantity (B+C) of the iron halide falls within the range of $1.0\times10^{-7} \leq (B+C) \leq 4.5\times10^{-7}$ [mol/cm$^3$] and a ratio {C/(B+C)} of the iron iodide ($FeBr_2$) in the iron halide ($FeX_2$) falls within the range of {C/(B+C)}=5 to 70%.

5 Claims, 5 Drawing Sheets

CROSS-SECTIONAL VIEW OF LAMP

(56) References Cited

U.S. PATENT DOCUMENTS

| | | | | |
|---|---|---|---|---|
| 4,158,789 | A * | 6/1979 | Scholz et al. | 313/633 |
| 4,243,906 | A * | 1/1981 | Wilson | 313/623 |
| 4,249,102 | A * | 2/1981 | Krieg et al. | 313/116 |
| 5,594,302 | A * | 1/1997 | Yakub et al. | 313/642 |
| 2009/0230867 | A1 * | 9/2009 | Wakahata et al. | 313/637 |

FOREIGN PATENT DOCUMENTS

| | | |
|---|---|---|
| JP | 52016887 | 2/1977 |
| JP | 02072551 | 3/1990 |
| JP | 02288152 | 11/1990 |
| JP | 10069883 | 3/1998 |
| JP | 10162774 | 6/1998 |
| JP | 2002008588 A | 1/2002 |
| JP | 2010129442 A | 6/2010 |

OTHER PUBLICATIONS

German Office Action for Application No. 11 2012 000 416.7 dated Mar. 27, 2014.

Full machine English translation of reference JP 2002-008588.

* cited by examiner

CROSS-SECTIONAL VIEW OF LAMP

TIME DEGRADATION CHARACTERISTICS OF LAMP ILLUMINANCE CONCERNING QUANTITY A OF METAL IRON

ILLUMINANCE CHARACTERISTICS
CONCERNING QUANTITY (B+C) OF IRON HALIDE

TIME DEGRADATION CHARACTERISTICS OF LAMP ILLUMINANCE CONCERNING RATIO {C/(B+C)} OF IRON BROMIDE IN IRON HALIDE

METAL HALIDE LAMP

CROSS REFERENCE TO RELATED APPLICATIONS

The present application is a national phase entry under 35 U.S.C. §371 of International Application No. PCT/JP2012/050001, filed Jan. 2, 2012, published in Japanese, which claims priority from Japanese Patent Application No. 2011-001015, filed Jan. 6, 2011, both of which are hereby incorporated herein by reference.

TECHNICAL FIELD

The present invention relates generally to a metal halide lamp. More specifically, this invention relates to a metal halide lamp for use in irradiating light of ultraviolet rays to cause a photochemical reaction which is suitable for use with, for example, a drying process of inks and paints and a curing process of resins and the like.

BACKGROUND ART

In recent years, metal halide lamps for irradiating light of ultraviolet rays are utilized in a wide variety of fields such as a printing process, a painting process and a resin sealing process. As metal halide lamps for use in these processes, there have hitherto been developed lamps capable of producing light of higher illumination level in order to efficiently carry out the treatments such as printing, painting and sealing in a short period of time. A high-pressure mercury lamp is a main current of a light source but there has been known a metal halide lamp of which luminous efficiency in the ultraviolet region is higher than that of the high-pressure mercury lamp. A metal halide lamp includes an arc tube into which metals are sealed as halides to produce light of a spectrum peculiar to metals.

The inventors of the present application are aware of the following patent literatures concerning such metal halide lamps for use in irradiating light of ultraviolet rays. Relevant parts in the respective patent literatures will be cited and mentioned.

CITATION LIST

Patent Literature

Patent Literature 1: Japanese unexamined patent publication No. 50-044675 (Date of laid-open: Apr. 22, 1975) "Metal vapor discharge lamp" (Applicant: IWASAKI ELECTRIC CO., LTD.)

Patent Literature 2: Japanese unexamined patent publication No. 52-16886 (Date of laid-open: Feb. 8, 1977) "Metal vapor discharge lamp" (Japanese examined patent publication No. 58-018743, Japanese Patent No. 1,262,477) (Applicant: IWASAKI ELECTRIC CO., LTD.)

Patent Literature 3: Japanese unexamined patent publication No. 02-072551 (Date of laid-open: Mar. 12, 1990) "Metal vapor discharge lamp" (Applicant: TOSHIBA LIGHTING AND TECHNOLOGY CORPORATION)

Patent Literature 4: Japanese unexamined patent publication No. 10-069883 (Date of laid-open: Mar. 10, 1998) "Metal vapor discharge lamp" (Applicant: IWASAKI ELECTRIC CO., LTD.)

Patent Literature 5: Japanese unexamined patent publication No. 2002-008588 (Date of laid-open: Jan. 11, 2002) "Metal vapor discharge lamp" (Japanese patent No. 4,411,749) (Applicant: JAPAN STORAGE BATTERY CO., LTD.)

The patent literature 1 discloses a metal vapor discharge lamp including an arc tube into which a halogen of a quantity of $0.1\times10^{-6}$ to $1.0\times10^{-6}$ gram atom in a per cubic centimeter of internal volume of the arc tube and an iron of a quantity of ½ to 3 times the quantity of the halogen in atomic ratio are sealed (claim for patent).

The patent literature 2 discloses a metal vapor discharge lamp including an arc tube into which a halogen, an iron and a tin are sealed together with mercury of a quantity large enough to maintain an arc discharge and a rare gas of a proper quantity. A quantity of halogen sealed into the arc tube is selected to be $1.0\times10^{-5}$ to $1.0\times10^{-8}$ gram atom in a per cubic centimeter of internal volume of the arc tube, a total quantity of an iron and a tin relative to the quantity of the halogen is selected to be ½ to 3 in atomic ratio, a quantity of tin relative to the iron is selected to be 1/20 to 3 in atomic ratio and light energy is concentrated on the ultraviolet region of the wavelength ranging of from 280 to 420 [nm] (claim of Japanese examined patent publication).

The patent literature 3 discloses a metal vapor discharge lamp including an arc tube into which an iron, a tin and a halogen are sealed in addition to mercury and a rare gas. In this metal vapor discharge lamp, silver is added in addition to the above-described iron and tin. When the quantities of the iron, the tin, the silver and the halogen sealed into the arc tube are respectively expressed as [Fe], [Sn], [Ag] and [J] by an atom gram number, these quantities are selected so as to satisfy $([Fe]+[Sn])/[J]<0.5$ and $(2[Fe]+2[Sn]+[Ag])/[J]>1$ (claim for patent).

The patent literature 4 discloses a metal vapor discharge lamp including an arc tube into which mercury, a rare gas, a halogen and, at least, more than one kind of metals of groups of an iron, cobalt and a nickel are sealed as luminescent materials. In this metal vapor discharge lamp, the quantities of the metals sealed into the arc tube except the mercury are selected so as to satisfy $A\times D\times V+B$ (A represents a reciprocal number of a valence of the metal sealed into the arc tube, D represents a density of halogen sealed into the arc tube, this density being selected so as fall within the range of $1\times10^{-5}$ to $1\times10^{4}$ mol/cm$^3$, V represents an interval volume in cm$^3$ of the arc tube and B represents a constant ranging of from $0.7\times10^{-4}$ to $3.6\times10^{-4}$ mol) (claim for patent).

The patent literature 5 discloses a metal vapor discharge lamp including an arc tube into which an iron is sealed as a main luminescent metal element and iodine is sealed as halogen. This metal vapor discharge lamp aims to increase emission intensity of light with a wavelength ranging from 450 to 500 nm without lowering starting performance (Abstract, paragraph [0008]). An argon gas is sealed into the arc tube as a starting rare gas and a partial pressure thereof is selected in a range of 5 to 10 [torr] (Abstract, paragraph [0020]). At least mercury is sealed into the arc tube thereof as a buffer gas, an iron is sealed into the arc tube thereof as a luminescent metal, iodine and bromine are sealed into the arc tube thereof as a halogen and a rare gas is sealed into the arc tube thereof as a starting gas. When (I) represents the sealed atom number of iodine per internal volume of the arc tube and (Br) represents the sealed atom number of bromine per internal volume of the arc tube, the quantity (Br)+(I) falls within the range of $2\times10^{-7}$ to $14\times10^{-7}$ (mol/cc) and the atomic ratio expressed by (Br):(I) falls within the range of 0:90 to 30:70 (claim 1).

Having compared these citations with the present invention simply, we may have the following compared results.

The patent literature 1 discloses only the metal vapor discharge lamp into which a halogen of a predetermined quantity and an iron of a quantity of ½ to 3 times the quantity of the halogen in atomic ratio are sealed.

The patent literature 2 discloses only the metal vapor discharge lamp into which a halogen of the predetermined quantity and the total quantity of iron and tin of ½ to 3 times the quantity of the halogen are sealed in atomic ratio.

The patent literature 3 discloses the iron, the tin, the silver and the halogen sealed into the lamp. Further, this patent literature has specified the quantities of the iron, the tin, the silver and the halogen.

The patent literature 4 discloses only the discharge lamp in which the required quantities of metals sealed into the lamp except mercury are specified in relation to the quantity of halogen.

The patent literature 5 aimed to increase the intensity of illumination of light with a wavelength ranging from 450 to 500 [nm], having observed starting performance. A pressure of an argon gas available as a starting rare gas is lowered in the range of 5 to 10 [torr] to thereby cancel deteriorated starting performance out. This patent literature is characterized by a wavelength of light and a pressure of a rare gas which are different from those of the inventive examples which will be described below. Further, having observed a quantity of an iron sealed into the lamp, it is to be noted that a quantity of (Fe) is selected in the range of $6\times10^{-7}$ [mol/cc], a quantity of (Sn) is selected in the range of $2\times10^{-7}$ [mol/cc] and a quantity of (I)+(Br) is selected in the range of $8\times10^{-7}$ [mol/cc] in the inventive example 1. Based on these numerical values, it is clear that (Fe) and (Sn) exist as iron halides and tin halides. Also, while the tin is merely replaced with a lead in the second inventive example, the tin or the iron is merely replaced with the iron in the third inventive example so that a relationship between the quantity of the metal and the quantity of the halogen is not changed at all. Accordingly, this patent literature is different from the present invention in which the quantity of the metal iron is increased independently of the quantity of the iron halides.

SUMMARY OF INVENTION

Technical Problem

The present invention is intended to provide a metal halide lamp for irradiating light of ultraviolet rays to cause a photochemical reaction for use in a drying process of inks and paints and a curing process of resins and the like. While a spectrum of light with a wavelength of 100 to 400 [nm] is generally referred to as light of ultraviolet rays, the present invention is intended to provide a metal halide lamp which can produce intense light of ultraviolet rays with a spectrum of, particularly, a wavelength ranging from 350 to 380 [nm] (the above light of ultraviolet rays will hereinafter be referred to as "light of ultraviolet rays near a wavelength 365 [nm]" which is a central wavelength).

The applicant of the present invention has paid attention to an iron (Fe) available as an luminescent material in the research and development of metal vapor discharge lamps and has proposed a metal vapor discharge lamp into which a halogen of a predetermined quantity and an iron of a quantity of ½ to 3 times the quantity of the halogen are sealed in atomic ratio in the patent literature 1. Further, in the patent literature 2, the applicant of the present invention has proposed a metal vapor discharge lamp into which an iron and a tin are sealed into the lamp in such a manner that a total quantity of the iron and the tin are selected to be ½ to 3 times the predetermined quantity of the halogen in atomic ratio and that the quantity of the tin is selected to be 1/20 to 3 times the quantity of the iron in atomic ratio.

A metal halide lamp containing irons shows a tendency such that iron and tungsten (W) of electrodes may react to each other to damage and deteriorate the electrodes under high temperature circumstances in which an arc discharge occurs.

Solution to Problem

In view of the above-described problems, an object of the present invention is to provide a novel ultraviolet ray irradiation metal halide lamp which can produce more intense light of ultraviolet rays with a wavelength near 365 [nm].

A metal halide lamp of the present invention is a metal halide lamp for producing mainly light of ultraviolet rays, said metal halide lamp comprising a lamp into which a rare gas and at least mercury and an iron are sealed to produce light with a high spectrum in ultraviolet rays, particularly, light with a wavelength of 350 to 380 [nm], in which said iron is supplied by iron iodide ($FeI_2$) and iron bromide ($FeBr_2$) as iron halide ($FeX_2$) and metal iron (Fe), when a quantity of the sealed iron is expressed such that A represents a quantity of metal iron (Fe) sealed into the lamp, B represents a quantity of iron iodide ($FeI_2$) sealed into the lamp and that C represents a quantity of iron bromide ($FeBr_2$) sealed into the lamp, respectively, the quantity A of said metal iron (Fe) falls within the range of $0.5(B+C)\leq A\leq 10.0(B+C)$ [mol/cm$^3$], the quantity (B+C) of said iron halide ($FeX_2$) falls within the range of $1.0\times10^{-7}\leq(B+C)\leq 4.5\times10^{-7}$ [mol/cm$^3$], and a ratio {C/(B+C)} of said iron bromide ($FeBr_2$) in said ion halide ($FeX_2$) falls within the range of {C/(B+C)}=5 to 70 [%].

Further, with respect to the above a metal halide lamp, said metal halide lamp may be characterized in that said quantity A of said metal iron (Fe) falls within the range of $0.5(B+C)\leq A\leq 3.0(B+C)$ [mol/cm$^3$], said quantity (B+C) of said iron halide ($FeX_2$) falls within the range of $2.0\times10^{-7}\leq(B+C)$ $3.5\times10^{-7}$ [mol/cm$^3$], and said ratio {C/(B+C)} of said iron bromide ($FeBr_2$) in said iron halide ($FeX_2$) falls within the range of {C/(B+C)}=5 to 60 [%].

Further, with respect to the above a metal halide lamp, said metal halide lamp may further comprise an argon (Ar) gas of 2.0 [kPa] sealed therein as said rare gas.

Further in a method of manufacturing a metal halide lamp of the present invention, a rare gas and at least mercury and an iron being sealed into the lamp to produce light of ultraviolet rays with a high spectrum, particularly, light with a wavelength of 350 to 380 [nm], the sealed iron being offered by iron iodide ($FeI_2$) and iron bromide ($FeBr_2$) as metal halide ($FeX_2$) and metal iron (Fe), in the process to determine the composition of the luminescent material, a quantity A of the metal iron (Fe) being determined such that $0.5(B+C)\leq A\leq 10.0(B+C)$ [mol/cm$^3$] is satisfied, a quantity (B+C) of the iron halide ($FeX_2$) being determined such that $1.0\times10^{-7}\leq(B+C)\leq 4.5\times10^{-7}$ [mol/cm$^3$] is satisfied and a ratio {C/(B+C)} of the iron bromide ($FeBr_2$) in the iron halide ($FeX_2$) being determined such that {C/(B+C)}=5 to 70% is satisfied, when a quantity of the sealed iron is expressed such that A represents a quantity of metal iron (Fe) sealed into the lamp, B represents a quantity of iron iodide ($FeI_2$) sealed into the lamp and C represents a quantity of iron bromide ($FeBr_2$) sealed into the lamp, respectively, said method of manufacturing a metal halide lamp comprising the steps of: manufacturing a quartz tube into a predetermined shape and connecting quartz pipes serving as electrode fixing portions to respective ends of the quartz tube of a central portion which serves as a light-emitting portion in an envelope manufacturing process; fixing electrodes to said quartz tube in a sealing process and a fusion-welding process; evacuating the inside of said quartz tube in an exhausting process and sealing the halide, the metal iron, mercury, the rare gas (argon gas, etc.) determined in the process to determine the composition of said luminescent material into said quartz tube and sealing an exhausting portion; and fixing bases to respective ends of said quartz tube in a finishing process.

Advantageous Effects of Invention

According to the present invention, it is possible to provide a novel ultraviolet-irradiation metal halide lamp which can produce more intense light of ultraviolet rays with a wavelength near 365 [nm]. Moreover, if this lamp is used, then it is possible to efficiently irradiate a liquid crystal material substance with light required by a photochemical reaction. Thus, it is possible to manufacture a highly efficient liquid crystal panel as compared with a prior-art liquid crystal panel.

DESCRIPTION OF EMBODIMENTS

Figure 1:
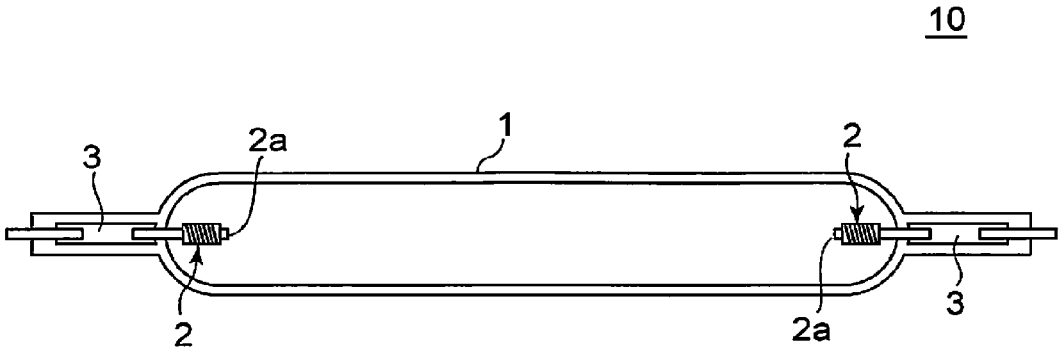
FIG. 1 is a schematic cross-sectional view of a metal halide lamp according to an embodiment of the present invention.

Embodiments of the present invention will hereinafter be described in detail with reference to the accompanying drawings. In the drawings, identical elements are denoted by identical reference numerals, respectively, and need not be described repeatedly. It should be noted that the embodiments of the present invention are used to explain the present invention by way of example and that these embodiments may not limit the scope of the present invention.

[Metal Halide Lamp]

A target metal halide lamp has physical sizes of its shape and the like which are identical to those of the lamp disclosed in the patent literature 4. FIG. 1 is a schematic cross-sectional view of this metal halide lamp 10. This metal halide lamp includes a quartz arc tube 1 that has a pair of electrodes 2, 2 provided within the arc tube. Each electrode includes an electrode tip end portion 2*a*. This electrode tip end portion comprises an electrode stem made of a tungsten (W) or a thoriated tungsten containing a thorium of a quantity of approximately 2 [%] or an oxide-doped tungsten with a doped rare earth oxide and a tungsten wire wound around the electrode stem several times in a coil fashion. The respective electrodes 2, 2 are connected to external lead wires through molybdenum foils 3, 3, respectively. The arc tube 1 is of a straight tube type and the inner diameter of the lamp tube is 20 mm, a distance between the electrodes (length of produced light) is 250 mm and an argon (Ar) gas of a pressure of 2.0 [kPa] (equivalent to approximately 15 [torr]) is sealed into the arc tube as a rare gas. Luminescent materials which are sealed into the arc tube will be described below.

[Compositions of Luminescent Materials]

Compositions of luminescent materials sealed into the lamp shown in FIG. 1 will be explained. A metal iron (Fe) and an iron halide ($FeX_2$) are used as luminescent materials. The iron halide, $FeX_2$ is made by a mixture of an iron iodide ($FeI_2$) and an iron bromide ($FeBr_2$).

In order to facilitate the explanation concerning the luminescent materials, respective elements will be marked below by symbols in which reference letter A represents a quantity of a metal iron (Fe) sealed into the lamp tube, B represents a quantity of an iron iodide ($FeI_2$) sealed into the lamp tube and C represents a quantity of an iron bromide ($FeBr_2$) sealed into the lamp tube. Accordingly, we may have the expression of an iron of luminescent material=metal iron (Fe)+iron halide ($FeX_2$)=metal iron (Fe)+iron iodide ($FeI_2$)+iron bromide ($FeBr_2$)=A+B+C.

(First Stage: Studies on a Quantity of a Metal Iron Fe)

At the first stage, we have made experiments to obtain the preferable quantity A of the metal iron (Fe). To be concrete, under the condition that the iron of the luminescent material=metal iron (Fe)+Iron halide ($FeX_2$)=A+(B+C) is satisfied, we have manufactured and evaluated a plurality of lamps while the quantity (B+C) of the iron halide was kept constant but the quantity A of the metal iron was being changed in the range of zero to 15 times the quantity (B+C) of the iron halide. A small quantity of a tin iodide ($SnI_2$) was used as an arc stabilizer. The iron halide may radically react with the tungsten (W) electrode under high temperature circumstances. In a like manner, the metal iron also may radically react with the tungsten (W) electrode. Accordingly, the preferable quantity A of the metal iron was evaluated by calculating time degradation characteristics of illuminance of the lamp.

TABLE 1

Time degradation characteristics of illuminance of lamp

| Sample Nos. | A Fe [mol/cm$^3$] | B $FeI_2$ [mol/cm$^3$] | C $FeBr_2$ [mol/cm$^3$] | B + C $FeX_2$ [mol/cm$^3$] | A/(B + C) Fe/$FeX_2$ | C/(B + C) $FeBr_2$/$FeX_2$ | $SnI_2$ [mol/cm$^3$] |
|---|---|---|---|---|---|---|---|
| 11 | zero | 2.0E−07 | 1.1E−07 | 3.1E−07 | zero | 0.365 | 0.20E−07 |
| 12 | 0.65E−07 | | | | 0.2 | | |
| 13 | 1.5E−07 | | | | 0.5 | | |

TABLE 1-continued

| Time degradation characteristics of illuminance of lamp | | | | | | | |
|---|---|---|---|---|---|---|---|
| Sample Nos. | A Fe [mol/cm$^3$] | B $FeI_2$ [mol/cm$^3$] | C $FeBr_2$ [mol/cm$^3$] | B + C $FeX_2$ [mol/cm$^3$] | A/(B + C) Fe/$FeX_2$ | C/(B + C) $FeBr_2$/$FeX_2$ | $SnI_2$ [mol/cm$^3$] |
| 14 | 9.1E−07 | | | | 3.0 | | |
| 15 | 31E−07 | | | | 10.0 | | |
| 16 | 46E−07 | | | | 15.0 | | |

Lamps used in experiments: metal halide lamp shown in FIG. 1

The table 1 shows data obtained from the respective lamps when the quantity (B+C) of the iron halide ($FeX_2$) sealed into the lamp was made constant while the quantities A of the metal iron (Fe) in the material sealed into the lamp were changed. The lamp used in the experiments is the lamp shown in FIG. 1. It should be noted that the sample Nos. on the table 1 are denoted by a 10 number in order to avoid overlapping of samples used in other experiments.

There were prepared six kinds of sample Nos. 11 to 16 in which the quantity (B+C) of the iron halide ($FeX_2$) sealed into the lamp was made constant while the quantities A of the metal iron (Fe) sealed into the lamp were being changed in the range of zero to $46\times10^{-7}$ [mol/cm$^3$].

Figure 2:
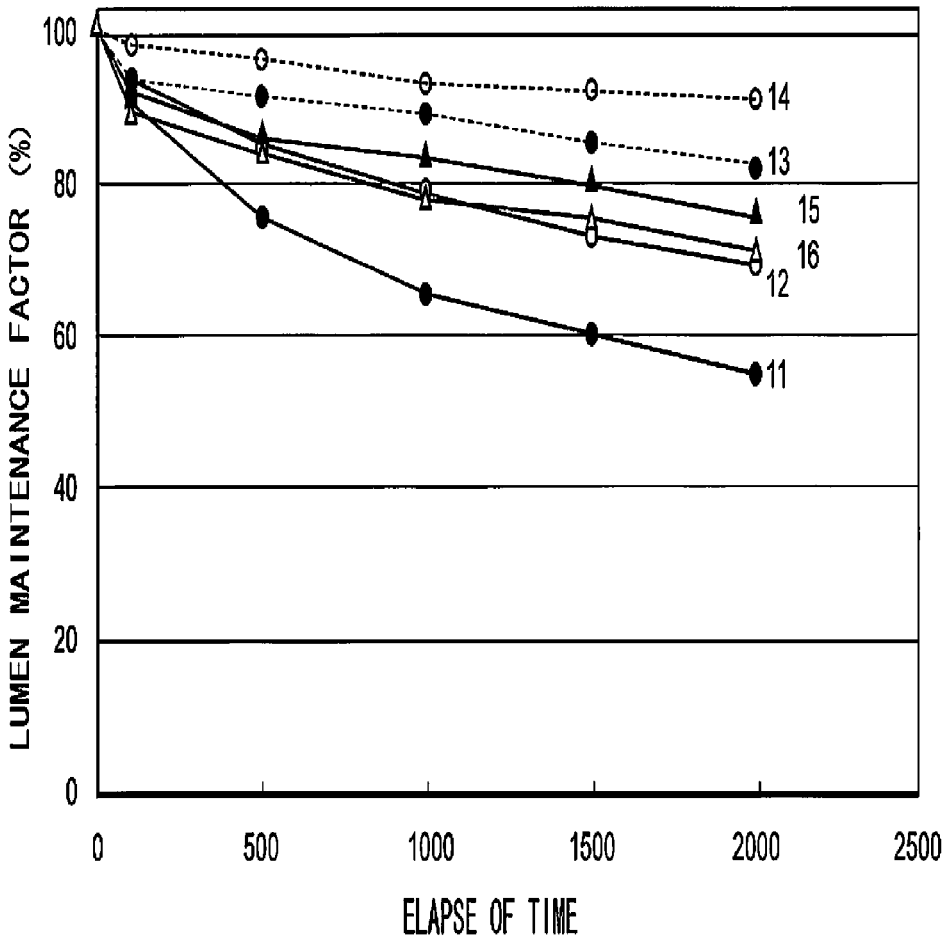
FIG. 2 is a graph showing measured results obtained when lumen maintenance factors of respective lamps were measured in the experiments to calculate a preferable quantity A of a metal iron (Fe) available as a luminescent material at the first stage.

In order to calculate time degradation characteristics of illuminance of the lamp, illuminance of every sample was measured at a wavelength of 365 [nm] after elapse of time of zero, 500, 1000, 1500 and 2000 hours. The illuminance of those samples was calculated and obtained as relative values under the condition that illuminance obtained from each sample immediately after each sample was manufactured (without elapse of time) was set to 100 [%] (this illuminance will hereinafter be referred to as an "initial illuminance"). These relative values were set to lumen maintenance factor [%] obtained after each elapse of time. FIG. 2 is a graph showing the thus obtained lumen maintenance factors.

It is said that a metal halide lamp has a nominal lifetime of approximately 1,500 hours. The sample Nos. 14, 13 and 15 had lumen maintenance factor higher than 80 [%] of the initial illuminance after elapse of time of 1,500 hours. Illuminance of the sample Nos. 16, 12 and 11 was lowered to less than 80 [%] of the initial illuminance.

The sample No. 11 has the quantity A of the metal iron (Fe)=zero. The sample No. 12 has the smallest quantity A of the metal iron (Fe). The sample No. 16 has the largest quantity A of the metal iron (Fe).

In the first place, having compared the sample No. 11 (A=zero) and other samples (A≠zero) with each other, it became clear that samples which contain the quantity A of the metal iron in addition to the quantity (B+C) of the iron halide had higher lumen maintenance factor. Next, it became clear that lumen maintenance factor could be improved in the sample Nos. 12 to 14 in which the quantities A of the metal iron were increased, lumen maintenance factor of the sample No. 14 could reach the peak value and that lumen maintenance factor was lowered in the sample Nos. 14 to 16 in which the quantity A of the metal iron was further increased. This may be considered such that the peak value of the lumen maintenance factor lies between the sample Nos. 13 and 15, i.e. the peak value of the lumen maintenance factor exists near the sample No. 14.

The reason that the lumen maintenance factor of the sample No. 11 is degraded comparatively rapidly may be considered in such a manner that, while the iron exists within the lamp tube as the iron halide ($FeI_2$), the iron halide radically reacts with the tungsten (W) of the electrode under high temperature circumstances to produce chemical compounds with the result that irons which contribute to the emission of light are lost with elapse of time. This is also true in the lamp of the sample No. 12. The reason for this may be considered such that, since the metal iron (Fe) of a very small quantity gradually reacts with the tungsten (W) of the electrode under high temperature circumstances, irons which may contribute to the emission of light are exhausted finally in a comparatively short period of time.

The quantity A of the metal iron (Fe) in the sample No. 16 corresponds to 15 times of the quantity (B+C) of the iron halide $FeX_2$. It may be considered that, since the metal iron of the excessively large quantity and the tungsten (W) of the electrode react with each other under high temperature circumstances, the electrode itself is damaged with elapse of time so that arc discharge is hindered to deteriorate illuminance of the sample of the lamp.

A study of the results shown in FIG. 2 reveals that the preferable lamps are those which can maintain illuminance higher than 80 [%] of the initial illuminance after elapse of time of 1,500 hours from a standpoint of maintaining the intensity of illumination of the lamp. A study of the table 1 reveals that the ratio of the quantity A of the metal iron (Fe) sealed into the lamp relative to the quantity (B+C) of the iron halide $FeX_2$ sealed into the lamp should preferably fall within the range of A/(B+C)=0.5 to 10.0 which correspond to the sample Nos. 13, 14 and 15. The quantity A should preferably be selected so as to fall within the range of $0.5(B+C)\leq A\leq 10.0(B+C)$ [mol/cm$^3$].

Further, the ratio of the quantity of the metal iron sealed into the lamp relative to the quantity of the iron halide sealed into the lamp should more preferably lie within the range of A/(B+C)=0.5 to 3.0 which correspond to the sample Nos. 13 and 14 that can maintain illuminance higher than 80 [%] of the initial illuminance even after elapse of time of 2,000 hours. The quantity A (quantity of metal iron) should be selected so to fall within the range of $0.5(B+C)\leq A\leq 3.0(B+C)$ [mol/cm$^3$].

(Second Stage: Studies on Quantity of Iron Halide $FeX_2$)

The preferable range of A (quantity of metal iron) became clear in the first stage. At the second stage, we have made experiments to calculate preferable quantities (B+C) of the iron halide ($FeX_2$) available as a preferable luminescent material within the range of the quantity A of the iron in the first stage.

Concretely, we have made the experiments with respect to the lamps in which the quantity A of the metal iron was kept constant but the quantity (B+C) of the iron halide was varied under the condition that an equality of irons in the luminescent material=metal iron (Fe)+iron halide ($FeX_2$)=A+(B+C) is satisfied. At the same time, we have made the experiments on comparative examples of lamps in which case an iron halide is composed of only the iron iodide ($FeI_2$) (B only) and the iron halide is composed of a mixture (B+C) of the iron iodide ($FeI_2$) and the iron bromide ($FeBr_2$). A thallium iodide (TlI) of a small quantity was used as an arc stabilizer.

The metal iron and the iron of the iron halide are sealed into the lamps as the luminescent material in order to improve illuminance of the lamp. Accordingly, an optimum quantity (B+C) of iron halide was evaluated based on measured results of illuminance of lamps.

TABLE 2

Illuminance characteristics concerning iron halide

| Sample Nos. | A Fe [mol/cm$^3$] | B $FeI_2$ [mol/cm$^3$] | C $FeBr_2$ [mol/cm$^3$] | B + C $FeX_2$ [mol/cm$^3$] | A/(B + C) Fe/$FeX_2$ | C/(B + C) $FeBr_2$/$FeX_2$ | TlI [mol/cm$^3$] | 365 nm Illuminance [%] |
|---|---|---|---|---|---|---|---|---|
| 21 | 13E−07 | 0.78E−07 | zero | 0.78E−07 | 16.6 | zero | 0.183E−07 | 100 |
| 22 | | 1.2E−07 | | 1.2E−07 | 11.1 | | | 109 |
| 23 | | 1.6E−07 | | 1.6E−07 | 8.3 | | | 115 |
| 24 | | 2.3E−07 | | 2.3E−07 | 5.5 | | | 113 |
| 25 | | 0.39E−07 | 0.22E−07 | 0.62E−07 | 21.1 | 0.365 | | 107 |
| 26 | | 0.78E−07 | 0.45E−07 | 1.2E−07 | 10.6 | 0.365 | | 118 |
| 27 | | 1.2E−07 | 0.67E−07 | 1.8E−07 | 7.02 | 0.365 | | 127 |
| 28 | | 1.6E−07 | 0.9E−07 | 2.5E−07 | 5.3 | 0.365 | | 129 |
| 29 | | 2.0E−07 | 1.1E−07 | 3.1E−07 | 4.2 | 0.365 | | 126 |
| 30 | | 2.4E−07 | 1.3E−07 | 3.6E−07 | 3.6 | 0.355 | | 124 |
| 31 | | 3.5E−07 | 2.1E−07 | 5.7E−07 | 2.3 | 0.377 | | 88 |

Lamp used in experiments: Metal halide lamp shown in FIG. 1

The lamp used in the experiments is the lamp shown in FIG. 1. In the sample Nos. 21 to 31 shown on the table 2, the quantity A of the metal iron (Fe) in the luminescent material is kept constant so as to satisfy an equality of $A=13\times10^{-7}$ [mol/cm$^3$]. The value thus selected as the quantity A is nearly a mean value of the sample Nos. 13, 14 and 15 which may fall within the preferable range. Sample Nos. on the table 2 are denoted by a 20 number and a 30 number in order to avoid overlapping of samples of lamps in other experiments.

The sample Nos. 21 to 24 may utilize only the iron iodide as the iron halide ($FeX_2$) (iron iodide B only) but they did not use the iron bromide ($FeBr_2$). The sample Nos. 25 to 31 use a mixture (B+C) of iron iodide and iron bromide as the iron halide.

In the sample Nos. 21 to 24 which use only the iron iodide B, the quantity of the iron bromide B is gradually varied so as to increase in the range of $0.78\times10^{-7}$ to $2.3\times10^{-7}$ [mol/cm$^3$]. Similarly, in the sample Nos. 25 to 31 which use the mixture (B+C) of the iron iodide and the iron bromide, the quantity (B+C) is gradually varied to so as to increase in the range of $0.62\times10^{-7}$ to $5.7\times10^{-7}$ [mol/cm$^3$].

Illuminance of the lamps was measured by an illuminometer suitable for use in measuring light with a wavelength of 365 [nm]. Measured data are shown on the table in such a manner that illuminance of the sample No. 21 is set to 100 [%] and that other measured data are shown thereon as relative values.

Figure 3:
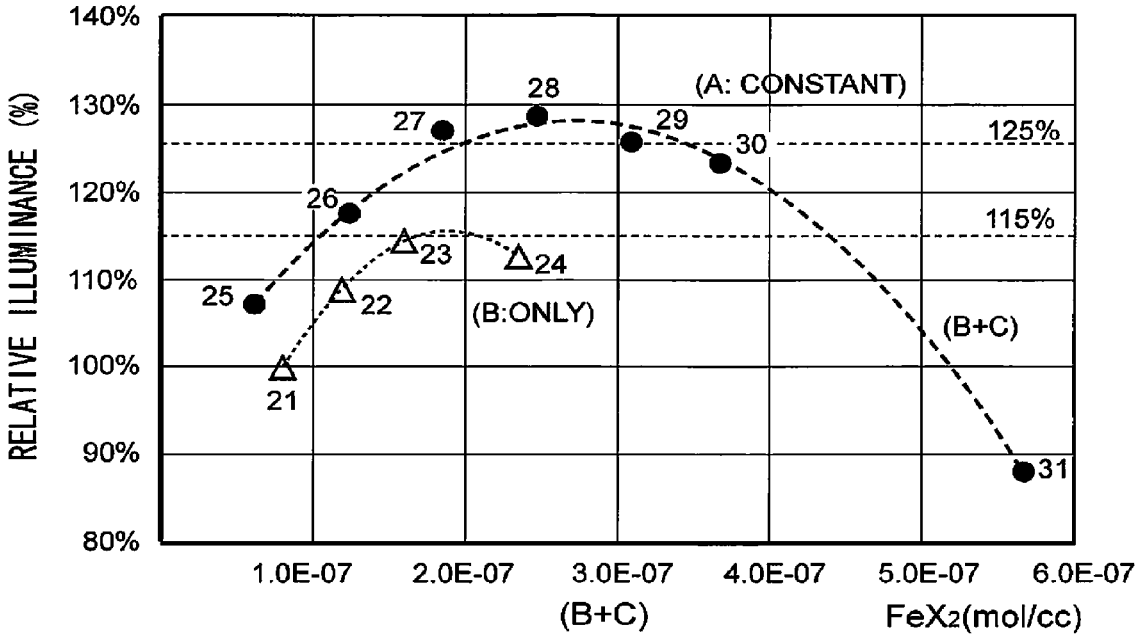
FIG. 3 is a graph showing measured results obtained when the intensities of illumination of respective lamps were measured in the experiments to calculate a preferable quantity (B+C) of an iron halide ($FeX_2$) available as a luminescent material at the second stage.

FIG. 3 is a graph showing measured results of illuminance of those samples of lamps. Having compared the samples of (B only) and the samples of (B+C) with each other, it became clear that all data show that illuminance of the samples of (B+C) was higher than illuminance of the samples of (B only) when the quantities of the iron halides are the same.

With respect to illuminance of the samples in which the iron halide is composed of only the iron iodide (B only), a study of this graph reveals that illuminance of the sample Nos. 21 to 23 in which the quantities of the iron iodide are increased could be improved. However, illuminance of sample Nos. 23 to 24 in which the quantities of the iron iodide were increased more was lowered conversely. With respect to illuminance of samples of (B+C), illuminance of sample Nos. 25 to 28 in which the quantity of the iron halide was increased could be improved. However, illuminance of sample Nos. 28 to 31 in which the quantity of the iron halide was increased more was gradually lowered conversely. As described above, with respect to both of the samples of (B only) and the samples of (B+C), there is a tendency that illuminance of the samples could be improved by the increase of the quantity of the iron halide, they reached their peak values by the constant quantity of the iron halide and that they are lowered by more increasing the quantity of the iron halide.

The iron is the luminescent material within the lamp. Accordingly, it might be considered that illuminance of the sample Nos. 21 to 23 and the sample Nos. 25 to 28 could be improved with the increase of the iron halide ($FeX_2$). On the other hand, illuminance of the sample Nos. 23 to 24 and the sample Nos. 28 to 31 was gradually lowered as the quantity of the iron halide is increased. The cause that illuminance of the samples was gradually lowered as the quantity of the iron halide was increased might be considered such that the peak value of illuminance was deviated from the wavelength of 365 [nm] and moved to other wavelengths.

A maximum value of relative illuminance of the lamp of (B only) lies near $B=1.8\times10^{-7}$ [mol/cm$^3$] and it is nearly 115 [%]. Accordingly, in order to obtain the benefits provided by the lamp of (B+C) in comparison with the lamp (B only), relative illuminance of the lamp of (B+C) should preferably be selected so as to become higher than 115 [%]. A study of FIG. 3 reveals that illuminance of the lamp of (B+C) should preferably be selected so as to fall within the range of $1.0\times10^{-7}\leq(B+C)\leq4.5\times10^{-7}$ [mol/cm$^3$]. On the table 2, data surrounded by the open rectangles along the (B+C) column of the sample Nos. 26 to 30 may correspond to the above-mentioned data. Further, relative illuminance of the lamp should more preferably be selected so as to fall within the range of $2.0\times10^{-7}\leq(B+C)\leq3.5\times10^{-7}$ [mol/cm$^3$] in which relative illuminance is higher than 125 [%].

(Third Stage: Studies on Ratio of Iron Bromide ($FeBr_2$) in Iron Halide ($FeX_2$))

The preferable range of the quantity A of the metal iron became clear at the first stage and the preferable range of the quantity (B+C) of the iron halide became clear at the second stage.

At the third stage, we have made the experiments to calculate a preferable ratio between the iron iodide (B) and the iron bromide (C) composing the iron halide (B+C) within the range of the quantity A ascertained at the first stage and within the range of the quantity (B+C) of the iron halide ascertained at the second stage. Concretely, we have made the experiments on respective lamps in which, under the condition that an equality of iron of material sealed into the lamp=metal iron (Fe)+iron halide ($FeX_2$)=A+(B+C) was satisfied, the quantity A and the quantity (B+C) were kept substantially constant within the ranges ascertained at the first and second stages and the ratio {C/(B+C)} of C relative to the quantity (B+C) was changed.

Irons of the metal iron (Fe) and the iron halide ($FeX_2$) are sealed into the lamp in order to improve illuminance of the lamp. On the other hand, the metal iron and the iron halide react with the tungsten (W) electrode. Accordingly, the preferable ratio {C/(B+C)} of the quantity of the iron bromide relative to the quantity of the iron halide was evaluated based on both standpoints of illuminance of the lamp and lumen maintenance factor.

With respect to illuminance data, illuminance of the sample No. 41 which does not contain the iron iodide C is selected to be 100 [%] and illuminance data of the respective lamps are indicated by relative values.

When samples are evaluated, initial illuminance should have a significant difference relative to a sample No. 41, i.e. illuminance should preferably be increased more than 10 [%]. Excepting sample No. 42, samples Nos. 43 to 48 might satisfy this condition. Based on these samples, it became clear that the ratio of the quantity of the iron bromide relative to the quantity of the iron halide should preferably be selected so as to fall within the range of substantially {C/(B+C)}≥5 [%].

Figure 4:
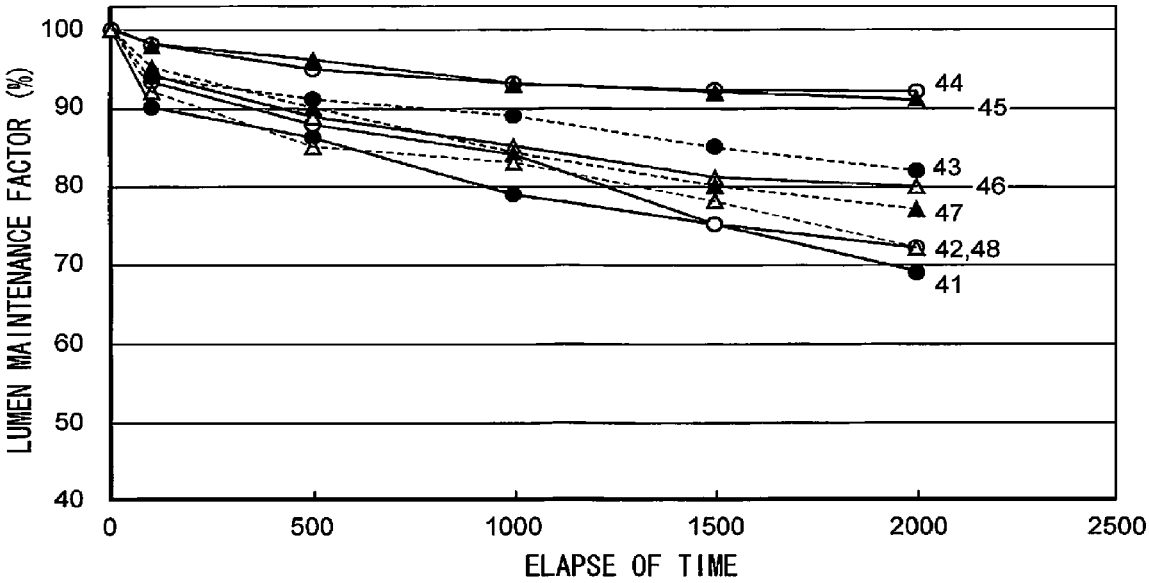
FIG. 4 is a graph showing measured results obtained when lumen maintenance factors of respective lamps were measured in the experiments to calculate a preferable ratio {C/(B+C)} between an iron iodide (B) and an iron bromide (C) composing a preferable iron halide ($FeX_2$) available as a luminescent material at the third stage.

Next, in order to obtain time degradation characteristics of illuminance, illuminance of any sample was measured after elapse of time of zero, 500, 1000, 1500 and 2000 hours and relative values were calculated under the condition that the initial illuminance of each sample was set to 100 [%], whereafter these calculated relative values were obtained as lumen maintenance factor [%] per elapse of each time. FIG. 4 is a graph showing these lumen maintenance factors.

A study of the results shown in FIG. 4 reveals that preferable lamps are those which can maintain more than 80 [%] of the initial illuminance after elapse of time of 1,500 hours from a standpoint of maintaining illuminance of the lamp. From FIG. 4, it became clear that the sample Nos. 44, 45, 43, 46 and 47 could satisfy the conditions of these lamps. Based on the table 3, it became clear that the quantities {C/(B+C)} of these sample Nos. 43 to 47 should preferably be selected so as to fall within the range of {C/(B+C)}=5 to 70 [%]. These samples should satisfy the conditions by which illuminance of the above-mentioned sample No. 41 could be improved more than 10 [%].

Further, referring to FIG. 4, it is to be understood that the sample Nos. 44, 45, 43 and 46 which can maintain more than 80 [%] of the initial illuminance after elapse of time of 2,000 hours should be more preferable. From the table 3, it became clear that the ratio of the iron iodide relative to the iron halide should be more preferably selected so as to fall within the range of {C/(B+C)}=5 to 60 [%] of the sample Nos. 43 to 46.

The sample Nos. 41 and 42 in which the ratio of {C/(B+C)} is zero or very small had no significant difference for the initial illuminance as described above and lumen maintenance factors thereof also were low. Based on these results, it became clear that when the ratio of {C/(B+C)}=zero, that is, when the iron halide is made of only the iron iodide (B only), as compared with the case of (B+C), lumen maintenance factors thereof were low at the third stage in addition to the fact that the initial illuminance thereof was low as was clear from the second stage. The samples in which the ratios of {C/(B+C)} are very small have the same tendency.

TABLE 3

Illuminance characteristics and time degradation characteristics of lamps

| Sample Nos. | A Fe [mol/cm³] | B $FeI_2$ [mol/cm³] | C $FeBr_2$ [mol/cm³] | B + C $FeX_2$ [mol/cm³] | A/(B + C) Fe/$Fx_2$ | C/(B + C) $FeBr_2$/$FeX_2$[%] | $SnI_2$ [mol/cm³] | Illuminance [%] |
|---|---|---|---|---|---|---|---|---|
| 41 | 9.1E−07 | 3.1E−07 | zero | 3.1E−07 | 3.0E−07 | zero | 0.52E−07 | 100 |
| 42 | | 2.9E−07 | 0.11E−07 | 3.0E−07 | | 3.7 | | 102 |
| 43 | | 2.9E−07 | 0.17E−07 | 3.1E−07 | | 5.5 | | 116 |
| 44 | | 2.3E−07 | 0.67E−07 | 3.0E−07 | | 22.3 | | 117 |
| 45 | | 2.0E−07 | 1.1E−07 | 3.1E−07 | | 36.5 | | 119 |
| 46 | | 1.4E−07 | 1.1E−07 | 3.1E−07 | | 55.2 | | 118 |
| 47 | | 1.0E−07 | 2.1E−07 | 3.2E−07 | 2.9E−07 | 67.7 | | 119 |
| 48 | | 7.8E−07 | 2.2E−07 | 3.0E−07 | 3.0E−07 | 74.2 | | 118 |

Lamp used in experiments: metal halide lamp shown in FIG. 1

The lamp used in the experiments is the lamp shown in FIG. 1. Based on the table 1 at the first stage and (the studies on the metal iron Fe) shown in FIG. 2, it became clear that the quantity A should preferably be selected so as to fall within the range of 0.5(B+C)≤A≤10.0(B+C) [mol/cm³]. Further, based on the table 2 at the second stage and (the quantity of the iron halide $FeX_2$) shown in FIG. 3, it became clear that the quantity (B+C) should preferably be selected so as to fall within the range of $1.0\times10^{-7}\leq(B+C)\leq4.5\times10^{-7}$ [mol/cm³]. At this third stage, the quantity A of the metal iron is made substantially constant such as $9.1\times10^{-7}$ [mol/cm³] within the range calculated at the first stage. The quantity (B+C) of the iron halide also is made substantially constant such as $3.0\times10^{-7}$ to $3.2\times10^{-7}$ [mol/cm³] within the range calculated at the second stage. On the table 3, data encircled by open rectangles in the column of A and the column of (B+C) correspond to the above quantity of the metal iron and the above quantity of the iron halide.

Under this condition, the ratio {C/(B+C)} of the quantity of the iron bromide relative to the quantity of the iron halide is gradually changed in the range of zero to 74.2 [%]. A tin iodide ($SnI_2$) of a small quantity is utilized as an arc stabilizer. It should be noted that sample Nos. on the table 3 are denoted by a 40 numbers in order to avoid overlapping of the samples in other experiments.

Illuminance data were measured by the illuminometer suitable for use in measuring light of a wavelength 365 [nm].

The sample Nos. 43 to 45 in which the ratio of {C/(B+C)} was increased gradually could improve initial illuminance such as initial illuminance of 116, 117, 119 [%] progressively as shown on the table 3 so that lumen maintenance factors thereof could be improved as shown in FIG. 4. However, sample Nos. 45 to 48 in which the ratio of {C/(B+C)} had further been increased reached the peak values thereof and lumen maintenance factors thereof also were lowered. That is, it became clear that, when the iron halide is composed of the mixture of the iron iodide and the iron bromide, the optimum peak value of the ratio {C/(B+C)} of the iron bromide relative to the quantity of the iron halide lies near the range of {C/(B+C)}=35 to 55 [%] which might cover the sample Nos. 45 and 46.

It became clear that, when the iron halide is composed of only the iron iodide (B only), resultant lamps should be inferior to those lamps composed of the mixture (B+C) of the iron halide of the iron iodide and the iron bromide from both of initial illuminance and lumen maintenance factor. Further, it became clear that good results of both of illuminance and lumen maintenance factor could be obtained by increasing the quantity of the iron bromide up to a certain quantity. However, since the iron bromide ($FeBr_2$) is relatively high in reactivity as compared with the iron iodide ($FeI_2$), if the iron bromide has an excessively large ratio in the iron halide, then such iron bromide can easily react with the tungsten (W) electrodes, thereby to lower lumen maintenance factor.

[Manufacturing Method of Metal Halide Lamp]

Figure 5:
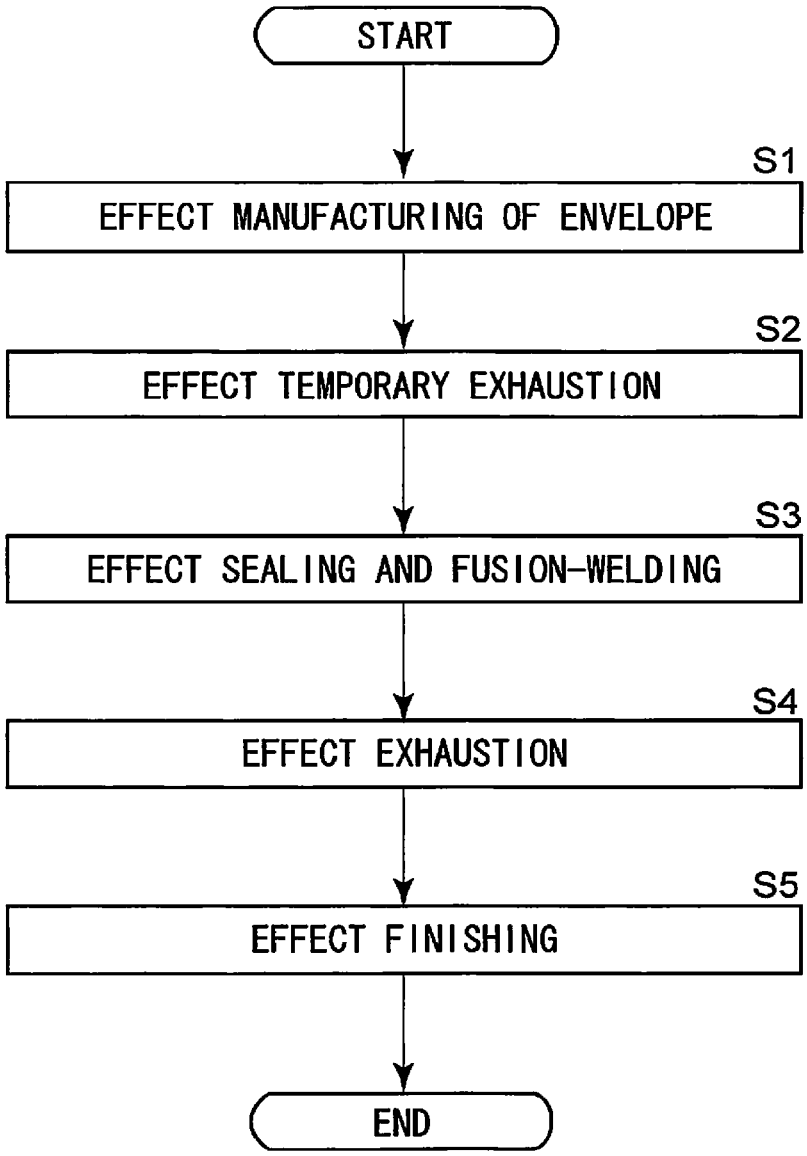
FIG. 5 is a flowchart to which reference will be made in explaining a method of manufacturing the lamp shown in FIG. 1.

A method of manufacturing this metal halide lamp will be described with reference to FIG. 5.

In a process for manufacturing an envelope of a lamp at a step S1, a quartz tube (depicted by reference numeral 1 in FIG. 1) is manufactured as a quartz tube of a desired shape. Quartz tubes that may serve as electrode fixing portions are connected to respective ends of the quartz tube 1 at its central portion which serves as a light-emitting portion of a lamp. A thin pipe (exhaust pipe) that serves both as a conduit to introduce a sealed material into the quartz tube and which serves also as an exhausting conduit within the quartz tube is connected in advance to the quartz tube at its central portion in the direction perpendicular to the quartz tube by fusion-welding (not shown).

In a temporary exhausting process at a step S2, the electrodes are sealed into the envelope and the envelope was evacuated, whereafter an inert gas such as an argon gas of a very small pressure was sealed into the envelope.

In a sealing process and a fusion-welding process at a step S3, the electrodes 2, 2 are fixed to the quartz tube.

In an exhausting process at a step S4, after the arc tube 1 was evacuated, halides and metal irons having predetermined compositions which will be described next and other elements such as mercury and a rare gas (argon gas, etc.) are sealed into the quartz tube and the exhaust pipe is sealed by a tipoff. Here, a high-purity iron reagent is used as the metal iron.

With respect to the iron and the iron halide sealed into the arc tube at this stage, the quantity A of the metal iron is determined so as to fall within the range of $0.5(B+C) \leq A \leq 10.0(B+C)$ [mol/cm$^3$] at the above-mentioned first stage, the quantity (B+C) of the iron halide is determined so as to fall within the range of $1.0\times10^{-7} \leq (B+C) \leq 4.5\times10^{-7}$ [mol/cm$^3$] at the second stage and the preferable ratio {C/(B+C)} of the quantity C of the iron bromide ($FeBr_2$) relative to the quantity B of the iron iodide comprising the iron halide is determined so as to fall within the range of {C/(B+C)}=5 to 70% at the third stage.

In a finishing process at a step S5, bases are fixed to the respective ends of the quartz tube 1.

Advantageous Effects of Invention (1) Through the experiments at the first stage, the preferable quantity A of the metal iron (Fe) could be determined as a sealed material with respect to irons which are luminescent materials. This quantity should preferably be selected so as to fall within the range of $0.5(B+C) \leq A \leq 10.0(B+C)$ [mol/cm$^3$]. More preferably, this quantity should be selected so as to fall within the range of $0.5(B+C) \leq A \leq 3.0(B+C)$ [mol/cm$^3$]

(2) Through the experiments at the second stage, illuminance of the lamp could be improved by adding the iron halide $FeX_2$ to the metal iron Fe to thereby increase the quantity of the iron as the luminescent material. That is, it became clear that illuminance of the lamp of (B only) and illuminance of the lamp of (B+C) could be improved by increasing the quantity of the iron halide, illuminance of the lamp could reach the peak value by a certain quantity of iron halide and that illuminance of the lamp tends to be lowered by further increasing the quantity of the iron halide more.

(3) Through the experiments at the second stage, illuminance of the lamp of (B only) and illuminance of the lamp of (B+C) were compared with each other. When the quantity of the iron halide ($FeX_2$) is the same, it became clear that illuminance of the lamp of (B+C) was higher than that of lamp of (B only).

(4) Through the experiments at the second stage, under the condition of the preferable quantity A of the metal iron (Fe) obtained at the first experiment, there could be determined the preferable quantity (B+C) of the iron halide ($FeX_2$).

This preferable quantity of the metal iron should preferably be selected so as to fall within the range of $1.0\times10^{-7} \leq (B+C) \leq 4.5\times10^{-7}$ [mol/cm$^3$]. This quantity should more preferably be selected so as to fall within the range of $2.0\times10^{-7} \leq (B+C) \leq 3.5\times10^{-7}$ [mol/cm$^3$].

(5) Through the experiments at the third stage, the lamp in which the iron halide is composed of only the iron iodide (B only) and the lamp in which the iron halide is composed of the mixture of the iron iodide and the iron bromide (B+C) were compared with each other. It became clear that the lamp in which the iron halide is composed of the mixture of the iron iodide and the iron bromide (B+C) is superior in lumen maintenance factor to the lamp in which the iron halide is composed of only the iron iodide (B only).

(6) Through the experiments at the third stage, there could be determined the preferable ratio {C/(B+C)} between the quantity B of the iron iodide ($FeI_2$) and the quantity C of the iron bromide ($FeBr_2$) comprising the iron halide ($FeX_2$).

This ratio should preferably be selected so as to fall within the range of {C/(B+C)}=5 to 70 [%]. This ratio should more preferably be selected so as to fall within the range of {C/(B+C)}=5 to 60 [%].

By determining the compositions of the sealed materials on the basis of the data concerning the quantities of the luminescent materials obtained from the above-mentioned experiments and stages (1) to (6), it became possible to manufacture a metal halide lamp for irradiating light of ultraviolet rays to cause a photochemical reaction and of which initial illuminance and lumen maintenance factor are high when light of ultraviolet rays has a wavelength of 350 to 380 [nm]. Moreover, since this wavelength region is such one that is most effective for causing a photochemical reaction to form a liquid crystal orientation, it becomes possible to manufacture a liquid crystal panel which can efficiently irradiate the material of the liquid crystal with light and which can realize more sufficiently accurate high-definition images than those of the prior-art.

Modified Example and Summary

While the examples of the metal halide lamp according to the present invention have been described so far, these examples are described by way of example and may not limit the scope of the present invention. Changes easily made on the present invention by those skilled in the art, such as addition, deletion modification and improvement may fall within the scope of the present invention.

For example, in the above-mentioned embodiments, the range of the preferable quantity A of the metal iron was calculated at the first stage. At the second stage, the range of the preferable quantity (B+C) of the iron halide was calculated under the condition of the preferable quantity A obtained in the first stage. At the third stage, under the condition of the range of the quantity A and the range of the quantity (B+C) obtained in the second and third stages, the range of the ratio {C/(B+C)} of the quantity C of the iron bromide relative to the preferable quantity (B+C) of the iron halide was calculated. The scope of the present invention is not limited to the decisions of this order.

When the range of the preferable quantity (B+C) and the range of the ratio {C/(B+C)} are determined, the range of the quantity (B+C) is determined first and the ratio {C/(B+C)} is determined next from a time standpoint. However, the order in which the range of the quantity A and the range of the quantity (B+C) are determined may not be limited to the above-mentioned one and it may be changed freely. In the patent literature 1, the applicant of the present invention has proposed the metal vapor discharge lamp into which a halogen of a predetermined quantity and "iron" of a quantity ½ to 3 times the quantity of the halogen in atomic ratio are sealed. Based on this experience, the range of the quantity (B+C) can be determined while the quantity A of the iron is being made constant.

Accordingly, if the order that has been described so far in the above-mentioned embodiments is selected as the order to determine the first luminescent material, the present invention is not limited thereto and the following second and third modified examples are made possible.

1. Second order to decide the first luminescent material
(first stage) the quantity A is made constant and the range of the quantity (B+C) is determined;
(second stage) the quantity (B+C) is made constant and the range of the quantity A is determined; and
(third stage) the quantity A and the quantity (B+C) are made constant and the range of the ratio {C/(B+C)} is determined.
2. Third order to decide the first luminescent material
(first stage) the quantity A is made constant and the range of the quantity (B+C) is determined;
(second stage) the quantity A and the quantity (B+C) are respectively made constant and the range of the ratio {C/(B+C)} is determined; and
(third stage) the quantity (B+C) and the ratio (C/(B+C)) are respectively made constant and the range of the quantity A is determined.

The technical scope of the present invention may be determined based on the descriptions of the scope of the appended claims.

REFERENCE SIGNS LIST

1: arc tube, 2: electrode, 2*a*: electrode tip end portion, 3: molybdenum foil, 10: metal halide lamp, A: quantity of metal iron (Fe) sealed into lamp, B: quantity of iron iodide ($FeI_2$) sealed into lamp, C: quantity of iron bromide ($FeBr_2$) sealed into lamp

The invention claimed is:

1. In a metal halide lamp for producing mainly light of ultraviolet rays,
said metal halide lamp comprising a lamp into which a rare gas and at least mercury and an iron are sealed to produce light with a high spectrum in ultraviolet rays, particularly, light with a wavelength of 350 to 380 [nm], in which said sealed iron is offered by iron iodide ($FeI_2$) and iron bromide ($FeBr_2$) as iron halide ($FeX_2$) and metal iron (Fe),
when a quantity of the sealed iron is expressed such that A represents a quantity of metal iron (Fe) sealed into the lamp, B represents a quantity of iron iodide ($FeI_2$) sealed into the lamp and that C represents a quantity of iron bromide ($FeBr_2$) sealed into the lamp, respectively,
the quantity A of said metal iron (Fe) falls within the range of $0.5\ (B+C) \leq A \leq 10.0\ (B+C)$ [mol/cm$^3$],
the quantity (B+C) of said iron halide ($FeX_2$) falls within the range of $1.0\times10^{-7} \leq (B+C) \leq 4.5\times10^{-7}$ [mol/cm$^3$], and
a ratio {C/(B+C)} of said iron bromide ($FeBr_2$) in said ion halide ($FeX_2$) falls within the range of {C/(B+C)}=5 to 70 [%].

2. In a metal halide lamp according to claim 1, said metal halide lamp is characterized in that,
said quantity A of said metal iron (Fe) falls within the range of $0.5\ (B+C) \leq A \leq 3.0\ (B+C)$ [mol/cm$^3$],
said quantity (B+C) of said iron halide ($FeX_2$) falls within the range of $2.0\times10^{-7} \leq (B+C) \leq 3.5\times10^{-7}$ [mol/cm$^3$], and
said ratio {C/(B+C)} of said iron bromide ($FeBr_2$) in said iron halide ($FeX_2$) falls within the range of {C/(B+C)}=5 to 60 [%].

3. In a metal halide lamp according to claim 1, said metal halide lamp further comprises an argon (Ar) gas of 2.0 [kPa] sealed therein as said rare gas.

4. In a method of manufacturing a metal halide lamp, a rare gas and at least mercury and an iron being sealed into the lamp to produce light of ultraviolet rays with a high spectrum, particularly, light with a wavelength of 350 to 380 [nm], the sealed iron being supplied by iron iodide ($FeI_r$) and iron bromide ($FeBr_2$) as metal halide ($FeX_2$) and metal iron (Fe),
in the process to determine the composition of the luminescent material, a quantity A of the metal iron (Fe) being determined such that $0.5\ (B+C) \leq A \leq 10.0\ (B+C)$ [mol/cm$^3$] is satisfied, a quantity (B+C) of the iron halide ($FeX_2$) being determined such that $1.0\times10^{-7} \leq (B+C) \leq 4.5\times10^{-7}$ [mol/cm$^3$] is satisfied and a ratio {C/(B+C)} of the iron bromide (FeBr) in the iron halide ($FeX_2$) being determined such that {C/(B+C)}=5 to 70% is satisfied, when a quantity of the sealed iron is expressed such that A represents a quantity of metal iron (Fe) sealed into the lamp, B represents a quantity of iron iodide ($FeI_2$) sealed into the lamp and C represents a quantity of iron bromide ($FeBr_2$) sealed into the lamp, respectively,
said method of manufacturing a metal halide lamp comprising the steps of:
manufacturing a quartz tube into a predetermined shape and connecting quartz pipes serving as electrode fixing portions to respective ends of the quartz tube of a central portion which serves as a light-emitting portion in an envelope manufacturing process;
fixing electrodes to said quartz tube in a sealing process and a fusion-welding process;

evacuating the inside of said quartz tube in an exhausting process and sealing the halide, the metal iron, mercury, the rare gas (argon gas, etc.) determined in the process to determine the composition of said luminescent material into said quartz tube and sealing an exhausting portion; and fixing bases to respective ends of said quartz tube in a finishing process.

5. In a metal halide lamp according to claim 2, said metal halide lamp further comprises an argon (Ar) gas of 2.0 [kPa] sealed therein as said rare gas.

* * * * *

UNITED STATES PATENT AND TRADEMARK OFFICE

CERTIFICATE OF CORRECTION

PATENT NO. : 8,749,138 B2
APPLICATION NO. : 13/978223
DATED : June 10, 2014
INVENTOR(S) : Orito et al.

It is certified that error appears in the above-identified patent and that said Letters Patent is hereby corrected as shown below:

In the Claims

Column 16, line 43, delete "$FeI_t$" and insert therefor --$FeI_2$--.

Signed and Sealed this
Ninth Day of February, 2016

Michelle K. Lee

Michelle K. Lee
*Director of the United States Patent and Trademark Office*